United States Patent [19]

Goodman

[11] Patent Number: 4,707,190

[45] Date of Patent: Nov. 17, 1987

[54] PROCESS FOR SEPARATING MALTOSE FROM MIXTURES OF MALTOSE, GLUCOSE AND OTHER SACCHARIDES

[75] Inventor: Walter H. Goodman, Oak Park, Ill.

[73] Assignee: UOP Inc., Des Plaines, Ill.

[21] Appl. No.: 902,739

[22] Filed: Sep. 2, 1986

[51] Int. Cl.[4] ..... C13J 1/06

[52] U.S. Cl. ..... 127/46.2; 127/46.3; 127/46.1

[58] Field of Search ..... 127/46.2, 46.3, 46.1

[56] References Cited

U.S. PATENT DOCUMENTS

| | | | |
|---|---|---|---|
| 2,985,589 | 5/1961 | Broughton | 210/34 |
| 3,040,777 | 6/1962 | Carson et al. | 137/625.15 |
| 3,293,192 | 12/1966 | Maher et al. | 252/430 |
| 3,422,848 | 1/1969 | Liebman et al. | 137/625.15 |
| 3,706,812 | 12/1972 | DeRosset et al. | 260/674 |
| 4,014,711 | 3/1977 | Odawara et al. | 127/46 |
| 4,182,634 | 1/1980 | Yamada et al. | 127/55 |
| 4,226,639 | 10/1980 | Michalko et al. | 127/46.2 |
| 4,294,623 | 10/1981 | Hidaka et al. | 127/55 |
| 4,379,751 | 4/1983 | Yoritomi et al. | 127/46.2 |
| 4,402,832 | 9/1983 | Gerhold | 210/659 |
| 4,405,377 | 9/1983 | Neuzil | 127/46.2 |
| 4,453,029 | 6/1984 | Dessau | 585/820 |
| 4,478,721 | 10/1984 | Gerhold | 210/659 |

FOREIGN PATENT DOCUMENTS 1585369 3/1981 United Kingdom .

OTHER PUBLICATIONS

Abe et al., article, Adsorption of Saccharides from Aqueous Solution onto Activated Carbon, Carbon, vol. 21, No. 3, pp. 189–191, 1983.

Fukushima et al., Japanese Public Disclosure No. 91012/86, Claims and Abstract only.

Julius Scherzer, The Preparation and Characterization of Aluminum-Deficient Zeolites, Catalytic Materials, Amer. Chem. Soc., 1984, pp. 157–200.

*Primary Examiner*—Andrew H. Metz
*Assistant Examiner*—Chung K. Pak
*Attorney, Agent, or Firm*—Thomas K. McBride; John F. Spears, Jr.; Jack H. Hall

[57] ABSTRACT

Maltose is separated from mixtures with glucose, DP3 and DP4+ polysaccharides by adsorption on low aluminum Y-type zeolites, i.e., having up to about 15 atoms of aluminum per unit cell and desorbing the adsorbate with water.

6 Claims, 3 Drawing Figures

PROCESS FOR SEPARATING MALTOSE FROM MIXTURES OF MALTOSE, GLUCOSE AND OTHER SACCHARIDES

BACKGROUND OF THE INVENTION

Maltose, or malt sugar, is a reducing sugar widely used as a nutrient or sweetener in the food industry. It also is used as culture media and stabilizer for polysulfides. It is primarily obtained from the enzymatic action of diastase or B-amylase on starch.

Starch hydrolysate may contain approximately 72% maltose, 1% glucose and 27% higher polysaccharides. At the present time, there are no known methods for commercially extracting the maltose present in starch hydrolysate from polysaccharides having a degree of polymerization (DP) greater than the glucose therein. However, in British Patent No. 1,585,369 a process is disclosed for separating a monosaccharide, such as fructose or glucose, from an oligosaccharide, such as maltose, using X zeolites exchanged with Ba or K cations or Y zeolites exchanged with Ba, Sr, Ca, Cs, Na or $NH_4$. However, the process of the British patent is not capable of separating maltose from glucose and a polysaccharide.

SUMMARY OF THE INVENTION

This invention relates to a process for separating maltose from a sugar source containing a mixture of maltose and at least one other sugar. Specifically, the invention is concerned with a process for separating and recovering high purity maltose from a sugar source which contains polysaccharides having DP's of 3, 4 and higher including starch or other high DP polysaccharides. More specifically, the invention concerns the use of a faujasite adsorbent having a very low aluminum content and particularly, up to about 15 atoms of aluminum per unit cell. The faujasites are useful because they have a pore size large enough to admit the sugar molecules being adsorbed. Silicalite and ZSM-5, on the other hand, have pore sizes too small to admit the saccharide molecules and, hence, are not effective for this separation. The preferred faujasite adsorbents contain up to about 9 aluminum atoms per unit cell and more preferably, from 5 to 9 aluminum atoms per unit cell.

As hereinbefore set forth, the present invention is concerned with a process for separating maltose from an aqueous mixture containing maltose and at least one other polysaccharide. The process is effected by passing a feed mixture containing one or more components over an adsorbent of the type hereinafter set forth in greater detail. The passage of the feed stream over the adsorbent will result in the adsorption of maltose while permitting the other components of the feed stream to pass through the treatment zone in an unchanged condition. Thereafter the maltose will be desorbed from the adsorbent by treating the adsorbent with a desorbent material, preferably water. Preferred adsorption and desorption conditions include a temperature in the range of from about 20° to about 200° C. and a pressure in the range of from about atmospheric to about 500 psig to ensure a liquid phase. The most particularly preferred conditions are 65° C. and about 50 psig.

DETAILED DESCRIPTION OF THE INVENTION

Figure 1:
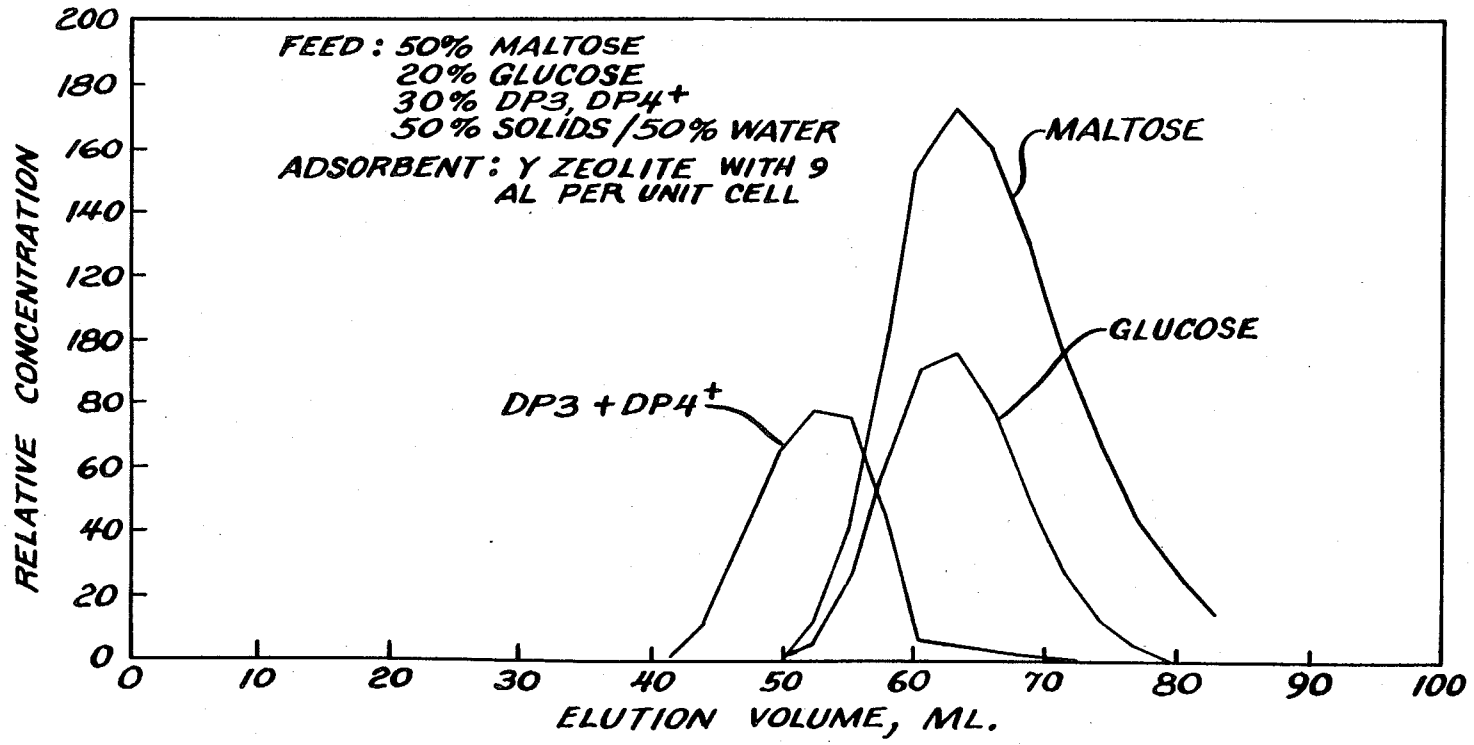
FIG. 1 is a chromatographic trace showing separation, by an adsorbent, comprising dealuminated Y faujasite, of maltose from glucose and higher oligosaccharides, i.e., having a degree of polymerization of 3, 4 and more.

For purposes of this invention, the various terms which are hereinafter used may be defined in the following manner.

A "feed mixture" is a mixture containing one or more extract components and one or more raffinate components to be separated by the process. The term "feed stream" indicates a stream of a feed mixture which passes to the adsorbent used in the process.

An "extract component" is a compound or type of compound that is more selectively adsorbed by the adsorbent while a "raffinate component" is a compound or type of compound that is less selectively adsorbed. The term "desorbent material" shall mean generally a material capable of desorbing an extract component. The term "desorbent stream" or "desorbent input stream" indicates the stream through which desorbent material passes to the adsorbent. The term "raffinate stream" or "raffinate output stream" means a stream through which a raffinate component is removed from the adsorbent. The composition of the raffinate stream can vary from essentially 100% desorbent material to essentially 100% raffinate components. The term "extract stream" or "extract output stream" shall mean a stream through which an extract material which has been desorbed by a desorbent material is removed from the adsorbent. The composition of the extract stream, likewise, can vary from essentially 100% desorbent material to essentially 100% extract components. At least a portion of the extract stream and preferably, at least a portion of the raffinate stream from the separation process are passed to separation means, typically fractionators, where at least a portion of desorbent material is separated to produce an extract product and a raffinate product. The terms "extract product" and "raffinate product" mean products produced by the process containing, respectively, an extract component and a raffinate component in higher concentrations than those found in the extract stream and the raffinate stream.

The feed mixtures which are charged to the process of the present invention will comprise sugar sources, a specific source which is utilized in the present invention comprising starch hydrolysate. As hereinbefore discussed, starch hydrolysate will contain about 72% maltose as well as other sugars and polysaccharides such as glucose, maltotriose (DP3), DP4 and higher (hereinafter DP4+) and starch, said other sugars and polysaccharides being present in varying amounts. The adsorbents of the present invention have been found to selectively adsorb maltose while allowing the other components in the sugar source to pass through the system unchanged. In addition, it has also been found that the initial capabilities of the adsorbent to selectively adsorb maltose is maintained during the actual use in the separation process over an economically desirable life. In addition, as previously set forth, the adsorbent of this invention possesses the ability to separate components of the feed, that is, that the adsorbent possesses adsorptive selectivity for one component as compared to other components. The adsorbents used in the separation of this invention are the so-called dealuminated Y-type zeolites obtained from Toyo Soda having respectively 15, 9 and 5 aluminum atoms per unit cell. It has been determined that zeolites of this type having 38 aluminum atoms per unit cell will not effect the desired separation between maltose and either glucose or polysaccharides which appears to indicate an upper limit to the amount of aluminum in the zeolitic structure. Furthermore, it appears that the lower the aluminum content the greater the separation between maltose and glucose. The zeolites may be made by one or more of the processes described in Julius Scherzer, The Preparation and Characterization of Aluminum-Deficient Zeolites, Catalytic Materials, *Amer. Chem. Soc.*, 1984, pp. 157–200, but preferably by the thermal dealumination process described on pages 158–161 involving the hydrothermal treatment of $NH_4Y$ zeolite, or U.S. Pat. No. 3,293,192 to Maher et al., to form the class of dealuminated Y zeolites referred to as "ultrastable." The references are hereby incorporated in their entirety by reference.

The number of aluminum atoms per unit cell of each sample used was determined X-ray diffractometry measurement of the cell dimension and comparing the dimension with previously recorded cell dimensions correlated with aluminum content.

Relative selectivity can be expressed not only for one feed compound as compared to another but can also be expressed between any feed mixture component and the desorbent material. The selectivity, (B), as used throughout this specification is defined as the ratio of the two components in the adsorbed phase over the ratio of the same two components in the unadsorbed phase at equilibrium conditions. Relative selectivity is shown as Equation 1, below.

$$\text{Selectivity} = \frac{[\text{wt. percent } C/\text{wt. percent } D]_A}{[\text{wt. percent } C/\text{wt. percent } D]_U} \qquad \text{Equation 1}$$

where C and D are two components of the feed represented in weight percent and the subscripts A and U represent the adsorbed and unadsorbed phases, respectively. The equilibrium conditions are determined when the feed passing over a bed of adsorbent does not change composition after contacting the bed of adsorbent, in other words, there is no net transfer of material occurring between the unadsorbed and adsorbed phases. Where selectivity of two components approaches 1.0, there is no preferential adsorption of one component by the adsorbent with respect to the other; they are both adsorbed (or nonadsorbed) to about the same degree with respect to each other. As the (B) becomes less than or greater than 1.0, there is a preferential adsorption by the adsorbent for one component with respect to the other. When comparing the selectivity by the adsorbent of one component C over component D, a (B) larger than 1.0 indicates preferential adsorption of component C within the adsorbent. A (B) less than 1.0 would indicate that component D is preferentially adsorbed leaving an unadsorbed phase richer in component C and an adsorbed phase richer in component D. Ideally, desorbent materials should have a selectivity equal to about 1 or slightly less than 1 with respect to all extract components so that all of the extract components can be desorbed as a class with reasonable flow rates of desorbent material, and so that extract components can displace desorbent material in a subsequent adsorption step. While separation of an extract component from a raffinate component is theoretically possible when the selectivity of the adsorbent for the extract component with respect to the raffinate component is greater than 1, it is preferred that such selectivity approach a value of 2. Like relative volatility, the higher the selectivity, the easier the separation is to perform. Higher selectivities permit a smaller amount of adsorbent to be used. The third important characteristic is the rate of exchange of the extract component of the feed mixture material or, in other words, the relative rate of desorption of the extract component. This characteristic relates directly to the amount of desorbent material that must be employed in the process to recover the extract component from the adsorbent; faster rates of exchange reduce the amount of desorbent material needed to remove the extract component and, therefore, permit a reduction in the operating cost of the process. With faster rates of exchange, less desorbent material has to be pumped through the process and separated from the extract stream for reuse in the process.

Desorbent materials used in various prior art adsorptive separation processes vary depending upon such factors as the type of operation employed. In the swing-bed system, in which the selectively adsorbed feed component is removed from the adsorbent by a purge stream, desorbent selection is not as critical and desorbent material comprising gaseous hydrocarbons such as methane, ethane, etc., or other types of gases such as nitrogen or hydrogen, may be used at elevated temperatures or reduced pressures or both to effectively purge the adsorbed feed component from the adsorbent. However, in adsorptive separation processes which are generally operated continuously at substantially constant pressures and temperatures to insure liquid phase, the desorbent material must be judiciously selected to satisfy many criteria. First, the desorbent material should displace an extract component from the adsorbent with reasonable mass flow rates without itself being so strongly adsorbed as to unduly prevent an extract component from displacing the desorbent material in a following adsorption cycle. Expressed in terms of the selectivity (hereinbefore discussed in more detail), it is preferred that the adsorbent be more selective for all of the extract components with respect to a raffinate component than it is for the desorbent material with respect to a raffinate component. Secondly, desorbent materials must be compatible with the particular adsorbent and the particular feed mixture. More specifically, they must not reduce or destroy the critical selectivity of the adsorbent for an extract component with respect to a raffinate component. Additionally, desorbent materials should not chemically react with or cause a chemical reaction of ejther an extract component or a raffinate component. Both the extract stream and the raffinate stream are typically removed from the adsorbent in admixture with desorbent material and any chemical reaction involving a desorbent material and an extract component or a raffinate component or both would complicate or prevent product recovery. Since both the raffinate stream and the extract stream typically contain desorbent materials, desorbent materials should additionally be substances which are easily separable from the feed mixture that is passed into the process. Without a method of separating at least a portion of the desorbent material present in the extract stream and the raffinate stream, the concentration of an extract component in the extract product and the concentration of a raffinate component in the raffinate product would not be very high, nor would the desorbent material be available for reuse in the process. It is contemplated that at least a portion of the desorbent material will be separated from the extract and the raffinate streams by distillation or evaporation, but other separation methods such as reverse osmosis may also be employed alone or in combination with distillation or evaporation. Since the raffinate and extract products herein are foodstuffs intended for human consumption, desorbent materials should also be nontoxic. Finally, desorbent materials should also be materials which are readily available and, therefore, reasonable in cost.

A dynamic testing apparatus is employed to test various adsorbents with a particular feed mixture and desorbent material to measure the adsorbent characteristics of adsorptive capacity, selectivity. and exchange rate. The apparatus consists of an adsorbent chamber of approximately 70 cc volume having inlet and outlet portions at opposite ends of the chamber. The chamber is contained within a temperature control means and, in addition, pressure control equipment is used to operate the chamber at a constant predetermined pressure. Quantitative and qualitative analytical equipment such as refractometers, polarimeters and chromatographs can be attached to the outlet line of the chamber and used to detect quantitatively or determine qualitatively one or more components in the effluent stream leaving the adsorbent chamber. A pulse test, performed using this apparatus and the following general procedure, is used to determine selectivities and other data for various adsorbent systems. The adsorbent is filled to equilibrium with a particular desorbent material by passing the desorbent material through the adsorbent chamber. At a convenient time, a pulse of feed containing known concentrations of maltose, glucose and other oligosaccharides all diluted in desorbent is injected for a duration of several minutes. Desorbent flow is resumed, and the maltose, glucose and other oligosaccharides are eluted as in a liquid-solid chromatographic operation. The effluent can be analyzed on-stream or, alternatively, effluent samples can be collected periodically and later analyzed separately by analytical equipment and traces of the envelopes of corresponding component peaks developed.

From information derived from the test, adsorbent performance can be rated in terms of void volume, retention volume for an extract or a raffinate component, selectivity for one component with respect to the other, and the rate of desorption of an extract component by the desorbent. The retention volume of an extract or a raffinate component may be characterized by the distance between the center of the peak envelope of an extract or a raffinate component and the peak envelope of the tracer component or some other known reference point. It is expressed in terms of the volume in cubic centimeters of desorbent pumped during this time interval represented by the distance between the peak envelopes. Selectivity, (B), for an extract component with respect to a raffinate component may be characterized by the ratio of the distance between the center of the extract component peak envelope and the tracer peak envelope (or other reference point) to the corresponding distance between the center of the raffinate component peak envelope and the tracer peak envelope. The rate of exchange of an extract component with the desorbent can generally be characterized by the width of the peak envelopes at half intensity. The narrower the peak width, the faster the desorption rate. The desorption rate can also be characterized by the distance between the center of the tracer peak envelope and the disappearance of an extract component which has just been desorbed. This distance is again the volume of desorbent pumped during this time interval.

The adsorbent may be employed in the form of a dense compact fixed bed which is alternately contacted with the feed mixture and desorbent materials. In the simplest embodiment of the invention, the adsorbent is employed in the form of a single static bed in which case the process is only semi-continuous. In another embodiment, a set of two or more static beds may be employed in fixed-bed contact with appropriate valving so that the feed mixture is passed through one or more adsorbent beds while the desorbent materials can be passed through one or more of the other beds in the set. The flow of feed mixture and desorbent materials may be either up or down through the desorbent. Any of the conventional apparatus employed in static bed fluid-solid contacting may be used.

Countercurrent moving bed or simulated moving bed countercurrent flow systems, however, have a much greater separation efficiency than fixed adsorbent bed systems and are, therefore, preferred. In the moving bed or simulated moving bed processes, the adsorption and desorption operations are continuously taking place which allows both continuous production of an extract and a raffinate stream and the continual use of feed and desorbent streams. One preferred embodiment of this process utilizes what is known in the art as the simulated moving bed countercurrent flow system. The operating principles and sequence of such a flow system are described in U.S. Pat. No. 2,985,589, incorporated by reference herein. In such a system, it is the progressive movement of multiple liquid access points down an adsorbent chamber that simulates the upward movement of adsorbent contained in the chamber. Only four of the access lines are active at any one time: the feed input stream, desorbent inlet stream, raffinate outlet stream, and extract outlet stream access lines. Coincident with this simulated upward movement of the solid adsorbent is the movement of the liquid occupying the void volume of the packed bed of adsorbent. So that countercurrent contact is maintained, a liquid flow down the adsorbent chamber may be provided by a pump. As an active liquid access point moves through a cycle, that is, from the top of the chamber to the bottom, the chamber circulation pump moves through different zones which require different flow rates. A programmed flow controller may be provided to set and regulate these flow rates.

The active liquid access points effectively divide the adsorbent chamber into separate zones, each of which has a different function. In this embodiment of the present process, it is generally necessary that three separate operational zones be present in order for the process to take place, although, in some instances, an optional fourth zone may be used.

The adsorption zone, zone 1, is defined as the adsorbent located between the feed inlet stream and the raffinate outlet stream. In this zone, the feedstock contacts the adsorbent, an extract component is adsorbed, and a raffinate stream is withdrawn. Since the general flow through zone 1 is from the feed stream which passes into the zone to the raffinate stream which passes out of the zone, the flow in this zone is considered to be a downstream direction when proceeding from the feed inlet to the raffinate outlet streams.

Immediately upstream, with respect to fluid flow in zone 1, is the purification zone, zone 2. The purification zone is defined as the adsorbent between the extract outlet stream and the feed inlet stream. The basic operations taking place in zone 2 are the displacement from the nonselective void volume of the adsorbent of any raffinate material carried into zone 2 by the shifting of adsorbent into this zone and the desorption of any raffinate material adsorbed within the selective pore volume of the adsorbent or adsorbed on the surfaces of the adsorbent particles. Purification is achieved by passing a portion of extract stream material leaving zone 3 into zone 2 at zone 2's upstream boundary, the extract outlet stream, to effect the displacement of raffinate material. The flow of material in zone 2 is in a downstream direction from the extract outlet stream to the feed inlet stream.

Immediately upstream of zone 2 with respect to the fluid flowing in zone 2 is the desorption zone or zone 3. The desorption zone is defined as the adsorbent between the desorbent inlet and the extract outlet streams. The function of the desorbent zone is to allow a desorbent material which passes into this zone to displace the extract component which was adsorbed upon the adsorbent during a previous contact with feed in zone 1 in a prior cycle of operation. The flow of fluid in zone 3 is essentially in the same direction as that of zones 1 and 2.

In some instances an optional buffer zone, zone 4, may be utilized. This zone, defined as the adsorbent between the raffinate outlet stream and the desorbent inlet stream, if used, is located immediately upstream with respect to the fluid flow to zone 3. Zone 4 would be utilized to conserve the amount of desorbent utilized in the desorption step since a portion of the raffinate stream which is removed from zone 1 can be passed into zone 4 to displace desorbent material present in that zone out of that zone into the desorption zone. Zone 4 will contain enough adsorbent so that raffinate material present in the raffinate stream passing out of zone 1 and into zone 4 can be prevented from passing into zone 3 thereby contaminating extract stream removed from zone 3. In the instances in which the fourth operational zone is not utilized, the raffinate stream passed from zone 1 to zone 4 must be carefully monitored in order that the flow directly from zone 1 to zone 3 can be stopped when there is an appreciable quantity of raffinate material present in the raffinate stream passing from zone 1 into zone 3 so that the extract outlet stream is not contaminated.

A cyclic advancement of the input and output streams through the fixed bed of adsorbent can be accomplished by utilizing a manifold system in which the valves in the manifold are operated in a sequential manner to effect the shifting of the input and output streams thereby allowing a flow of fluid with respect to solid adsorbent in a countercurrent manner. Another mode of operation which can effect the countercurrent flow of solid adsorbent with respect to fluid involves the use of a rotating disc valve in which the input and output streams are connected to the valve and the lines through which feed input, extract output, desorbent input and raffinate output streams are advanced in the same direction through the adsorbent bed. Both the manifold arrangement and disc valve are known in the art. Specifically, rotary disc valves which can be utilized in this operation can be found in U.S. Pat. Nos. 3,040,777 and 3,422,848. Both of the aforementioned patents disclose a rotary type connection valve in which the suitable advancement of the various input and output streams from fixed sources can be achieved without difficulty.

In many instances, one operational zone will contain a much larger quantity of adsorbent than some other operational zone. For instance, in some operations the buffer zone can contain a minor amount of adsorbent as compared to the adsorbent required for the adsorption and purification zones. It can also be seen that in instances in which desorbent is used which can easily desorb extract material from the adsorbent that a relatively small amount of adsorbent will be needed in a desorption zone as compared to the adsorbent needed in the buffer zone or adsorption zone or purification zone or all of them. Since it is not required that the adsorbent be located in a single column, the use of multiple chambers or a series of columns is within the scope of the invention.

It is not necessary that all of the input or output streams be simultaneously used, and in fact, in many instances some of the streams can be shut off while others effect an input or output of material. The apparatus which can be utilized to effect the process of this invention can also contain a series of individual beds connected by connecting conduits upon which are placed input or output taps to which the various input or output streams can be attached and alternately and periodically shifted to effect continuous operation. In some instances, the connecting conduits can be connected to transfer taps which during the normal operations do not function as a conduit through which material passes into or out of the process.

It is contemplated that at least a portion of the extract output stream will pass into a separation means wherein at least a portion of the desorbent material can be separated to produce an extract product containing a reduced concentration of desorbent material. Preferably, but not necessary to the operation of the process, at least a portion of the raffinate output stream will also be passed to a separation means wherein at least a portion of the desorbent material can be separated to produce a desorbent stream which can be reused in the process and a raffinate product containing a reduced concentration of desorbent material. Separation will typically be by crystallization. The design and operation of crystallization apparatus are well known to the separation art.

Although both liquid and vapor phase operations can be used in many adsorptive separation processes, liquid-phase operation is preferred for this process because of the lower temperature requirements and because of the higher yields of extract product that can be obtained with liquid-phase operation over those obtained with vapor-phase operation. Adsorption conditions will include a temperature range of from about 20° to about 200° C., with 20° to about 100° C. being more preferred and a pressure range of from about atmospheric to about 500 psig with from about atmospheric to about 250 psig being more preferred to insure liquid phase. Desorption conditions will include the same range of temperatures and pressures as used for adsorption conditions.

The size of the units which can utilize the process of this invention can vary anywhere from those of pilot plant scale (see for example my assignee's U.S. Pat. No.

3,706,812) to those of commercial scale and can range in flow rates from as little as a few cc's an hour up to many thousands of gallons per hour.

Another embodiment of a simulated moving bed flow system suitable for use in the process of the present invention is the cocurrent high efficiency simulated moving bed process disclosed in U.S. Pat. Nos. 4,402,832 and 4,478,721 to Gerhold, incorporated by reference herein in its entirety. This process may be preferred, because of its energy efficiency and lower capital intensity, where products of slightly lower purity are acceptable.

The examples shown below are intended to further illustrate the process of this invention and are not to be construed as unduly limiting the scope and spirit of said process. The examples present test results for various adsorbent and desorbent materials when using the previously described dynamic testing apparatus.

EXAMPLE I

In this example, a test was run using a dealuminated Y-type zeolite having 9 aluminum atoms per unit cell to determine the separation of maltose from a mixture representative of that expected from an enzymatic degradation of starch by B-amylase or diastase. The dealuminated Y-type zeolite of this example was bound in Bentolite clay and had an average bulk density of 0.536 g/ml. The adsorbent was packed in an 8.4 mm diameter column having a total volume of 70 cc. The feed mixture consisted of 10 g of the carbohydrate mixture given in Table 1 diluted with 10 g of distilled water resulting in a solution containing 50% of solids.

TABLE 1

| | Wt. % Dry Solids |
|---|---|
| Maltose | 50 |
| Glucose | 20 |
| Maltrin 150 (DP3, DP4+) | 30 |
| | 100 |

Maltrin 150 is a commercially available mixture containing 88% saccharides having a degree of polymerization of 4 or more (DP4+), 8.1% maltotriose, having a DP of 3, about 3% maltose and less than 2% glucose.

The experiment began by passing a water desorbent through the column at a flow rate of 1.4 cc/min. and a temperature of 65° C. At a convenient time, 2 ml of feed was injected into the column after which flow of desorbent was immediately resumed. FIG. 1 provides a graphical representation of the adsorbent's retention of the various sugars in the feed.

A consideration of the average midpoint for each concentration curve reveals separation of maltose from the other feed mixture sugars. While a substantial portion of the maltose curve does lie within the glucose curve, there is adequate maltose/glucose selectivity as seen by the differences in retention volume (ΔR.V.) shown in Table 2; B (selectivity) maltose/glucose is 1.18, calculated in the manner discussed heretofore. Excellent selectivity of the adsorbent for maltose compared to the DP3 and DP4+ component was found shown by the large ΔR.V. in Table 2.

TABLE 2

| | Δ R.V. (ml) |
|---|---|
| Maltose/Glucose | 2.0 |
| Maltose/DP3 + DP4+ | 12.5 |

EXAMPLE II

To show the separation of maltose with a different amount of aluminum in the crystalline structure of the adsorbent, another test was run using a Y-type zeolite having 5 aluminum atoms per unit cell in the same testing apparatus. The zeolite was bound with silica which had no effect on the separation. The feed mixture consisted of the following:

TABLE 3

| | Wt. % |
|---|---|
| Maltose | 5 |
| Glucose | 5 |
| Maltotriose (DP3) | 5.5 |
| DP4+ | 4.5 |
| Water | 80 |

Figure 2:
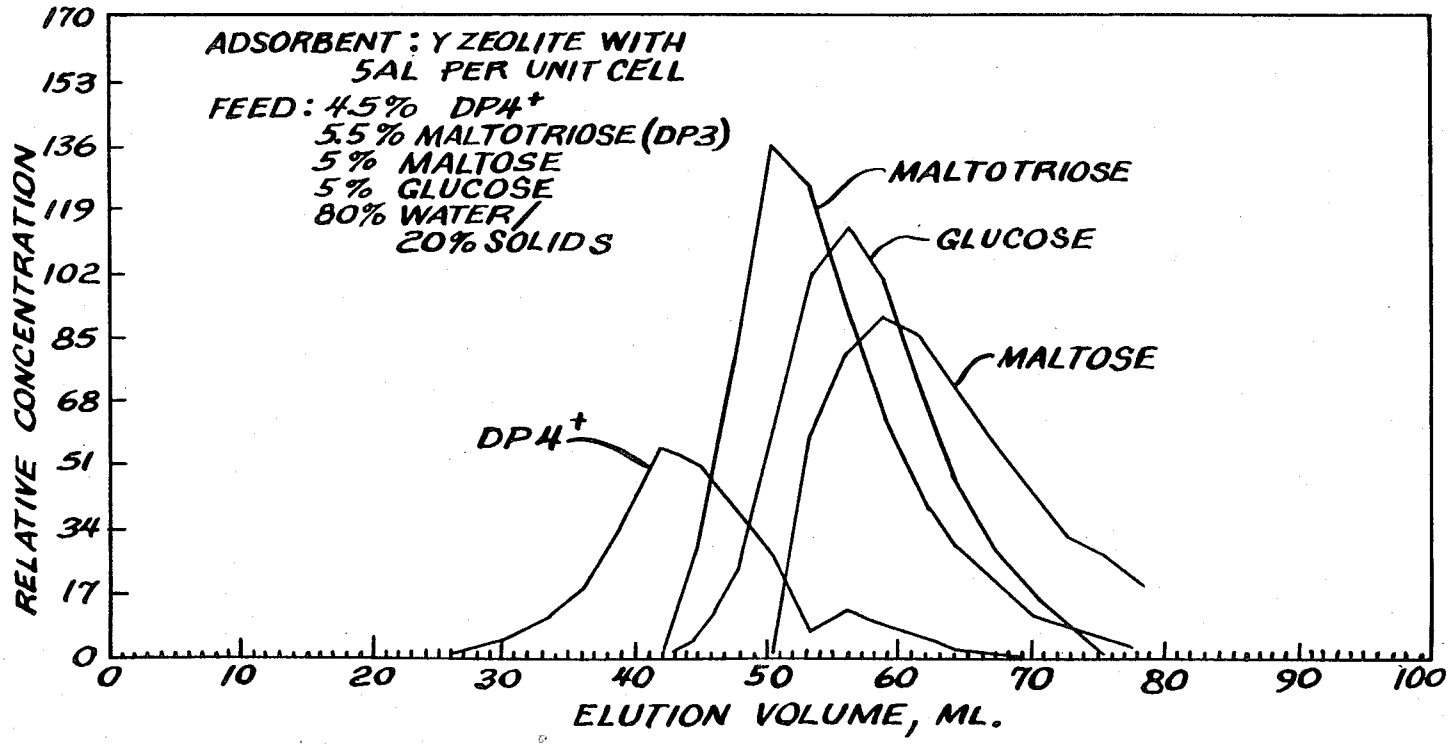
FIG. 2 is a chromatographic trace showing separation of maltose from glucose and oligosaccharides.

The pulse test was conducted in the same manner as Example I. FIG. 2 shows graphically the relative retention of the sugars by the adsorbent.

By considering the average midpoint of component envelopes, it is apparent that a good separation of maltose from glucose and from DP3 and DP4 was obtained. The difference between the retention volumes of maltose and glucose is 3.5 ml and between maltose and DP3+DP4+ is 12.0 ml. B maltose/glucose=1.3; B maltose/maltotriose=1.95. In a computer simulation of a separation based on the above data and FIG. 2, the material balance in Table 4 was obtained using a feed having the following composition (all on a dry solids basis).

| | |
|---|---|
| Maltose | 72.0% |
| Glucose | 1.0 |
| DP3 | 13.0 |
| DP4+ | 14.0 |
| Others | 0.0 |

The adsorbent was the same faujasite used in the first part of this example having 5 aluminum atoms per unit cell. A total volume of adsorbent used was 2553.1 cu. ft. (weight 127,654 lbs.). The simulation was based on a countercurrent simulated moving bed system described hereinabove and in U.S. Pat. No. 2,985,589, with 24 beds, each 7.4 ft. in diameter and 2.5 ft. high.

TABLE 4

| Stream Component | Extract (%) (Purity) | Recovery (%) | Raffinate (%) |
|---|---|---|---|
| Maltose | 97.3 | 92.5 | 17.1 |
| Glucose | 1.3 | 88.1 | 0.4 |
| DP3 | 1.3 | 6.79 | 38.4 |
| DP4+ | 0.1 | 0.45 | 44.1 |
| Others | 0.0 | 0.45 | 0.0 |

The selectivity of maltose/glucose was 1.36. The selectivity of maltose/DP3 is 1.95. The selectivity of maltose/DP4+ is very high, since the DP4+ component is adsorbed in minute quantities only.

EXAMPLE III

Figure 3:
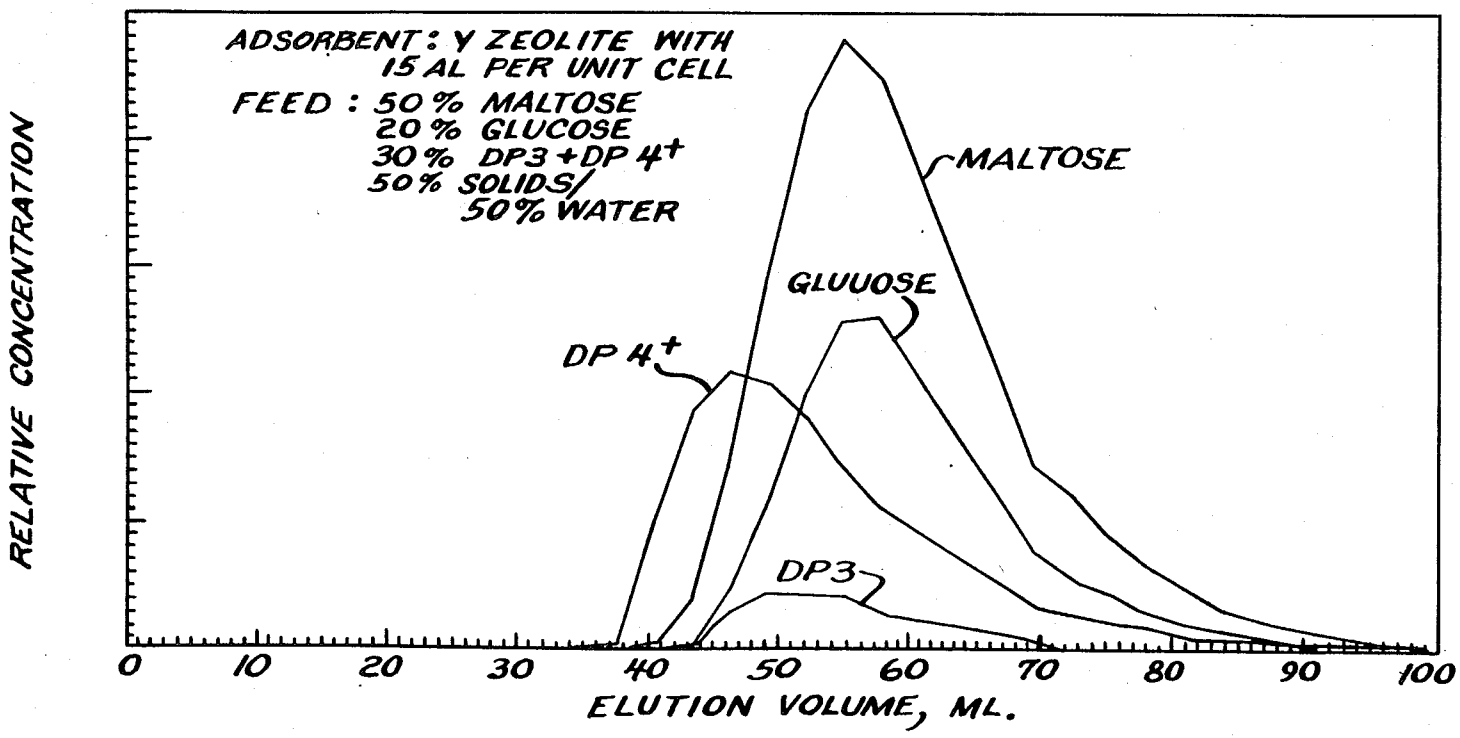
FIG. 3 is a chromatographic trace showing separation of maltose from oligosaccharides DP3 and DP4+.

Another pulse test was conducted with the same feed mixture using a dealuminated Y faujasite zeolite having 15 aluminum atoms per unit cell. FIG. 3 shows the separation of maltose from DP3 and DP4+, but glucose elutes at the same time as the maltose with no separation. The difference between the retention volumes of maltose and DP3 and DP4+ is 8.5 and good separation can be achieved thereby. No separation is achieved between maltose and glucose ($\Delta$R.V.=0 and B maltose/glucose=0.85).

EXAMPLE IV

Example II was repeated except that the faujasite had 38 aluminum atoms per unit cell. As in Example III, the glucose elutes with the maltose. Maltotriose has less than 1 ml difference in retention volume, indicating that no separation of maltose from either glucose or DP3 saccharides is practically realized.

What is claimed is:

1. A process for separating maltose from a mixture of maltose, glucose and at least one polysaccharide which comprises contacting said mixture at adsorption conditions with an adsorbent comprising a dealuminated Y zeolite having about 5–9 aluminum atoms per unit cell, selectively adsorbing said maltose, removing the nonadsorbed portion of said mixture from contact with said adsorbent and thereafter recovering high purity maltose by desorption with a desorbent comprising water at desorption conditions.

2. The process of claim 1 wherein said adsorption and desorption conditions include a temperature range of from about 20° to about 100° C. and a pressure range of from about atmospheric to about 250 psig.

3. The process of claim 1 wherein said at least one polysacchride is selected from the group consisting of maltotriose (DP3) and DP4.

4. The process of claim 1 wherein said at least one polysaccharide has a degree of polymerization of 3 or greater.

5. A process for separating maltose from a mixture of maltose and at least one polysaccharide having a degree of polymerization of 3 or greater which comprises contacting said mixture with an adsorbent comprising a dealuminated Y zeolite having about 5–9 aluminum atoms per unit cell, selectively adsorbing said maltose, removing the nonadsorbed portion of said mixture from contact with said adsorbent and thereafter recovering high purity maltose by desorption with a desorbent at desorption conditions.

6. The process of claim 5 wherein said at least one polysaccharide is selected from the group consisting of maltotriose and saccharides having a degree of polymerization of 3 or more.

* * * * *